United States Patent [19]

Wise

[11] 4,364,555

[45] Dec. 21, 1982

[54] SHEET TRANSFER APPARATUS

[75] Inventor: Robert J. Wise, Eugene, Oreg.

[73] Assignee: Georgia-Pacific Corporation, Atlanta, Ga.

[21] Appl. No.: 206,964

[22] Filed: Nov. 14, 1980

[51] Int. Cl.[3] ..... B65H 29/32

[52] U.S. Cl. ..... 271/308; 271/197

[58] Field of Search ..... 271/5, 6, 308, 180, 271/181, 197

[56] References Cited

U.S. PATENT DOCUMENTS

| | | | |
|---|---|---|---|
| 3,305,233 | 2/1967 | Cody | 271/197 X |
| 3,406,966 | 10/1968 | Walton | 271/197 X |
| 3,490,764 | 1/1970 | Müller | 271/197 X |
| 4,275,977 | 6/1981 | Joice | 271/197 X |

*Primary Examiner*—Richard A. Schacher

*Attorney, Agent, or Firm*—Schuyler, Banner, Birch, McKie & Beckett

[57] ABSTRACT

A sheet transfer apparatus (10) is disclosed. The apparatus (10) includes a first station (14), a second station (16) and a transfer mechanism (18) for transferring stiff sheets (20A,B) from the first station (14) to the second station (16). A conveyor mechanism (48) moves the sheet (20B) in a first direction (49) from the second station (16). Push-plates (32) are provided for releasing the sheet (20B) from the transfer mechanism (10) at the second station (16). A pair of longitudinally spaced bar members (50) apply downward pressure to a sheet (20B) falling downward onto the conveyor mechanism (48). Each bar member (50) is supported in an inoperative position by one of the push-plates (32).

22 Claims, 5 Drawing Figures

SHEET TRANSFER APPARATUS

TECHNICAL FIELD

The present invention relates to an article handling apparatus for transferring stiff structural sheets, such as wood veneers. The apparatus of the present invention is useful in transferring stiff sheets from one processing station to another in a plywood or similar article assembly apparatus.

BACKGROUND OF THE INVENTION

Numerous types of conveyors have been used in the prior art to transfer or load sheet material. In the manufacture of plywood, a plurality of veneers are laid one upon another at a plurality of locations along a glue line conveyor. At these locations a sheet transfer device is used to transfer an individual sheet of veneer from a stack of sheets to the conveyer.

One type of transfer mechanism or conveyor supports a sheet being conveyed by its bottom surface and feeds the sheet off the end of the conveyor onto a concurrently moving primary conveyor disposed below it. Such a transfer device is shown in U.S. Pat. No. 3,504,732 issued to Robert J. Slagle, et al. on Apr. 7, 1970.

Another type of transfer device deposits a transferred sheet above a desired location and allows the sheet to float downward. The present invention is directed to an improvement in this type of device. One such transfer device is disclosed in U.S. Pat. No. 3,490,614 issued to Russell W. Wilson, et al. on Jan. 20, 1970. The transfer device disclosed in U.S. Pat. No. 3,490,614 lifts an uppermost sheet from a stack at a first station with a vacuum or suction lifting force, supports the sheet in a lifted position by means of the vacuum and transfers the sheet to a second station. While maintaining the vacuum lift, a releasing force is applied to the sheet in a direction opposite to that in which the vacuum is supplied. The releasing force is greater than the force exerted by the vacuum lift and, hence, the sheet is separated from the vacuum lift and allowed to float downwardly to a desired location at the second station. A lengthwise edge of the sheet is aligned at the second station. A floating weight assembly is provided for stablizing the sheet as it floats downwardly. The weight assembly, however, utilizes only two discrete shoes adjacent the edges being aligned for providing downward pressure upon the sheet.

SUMMARY OF THE INVENTION

The present invention is directed to an improvement in a sheet transfer apparatus. The apparatus includes a transfer means for transferring stiff sheets from a first station to a second station. A release means releases a sheet held by the transfer means at the second station and provides a downward force on the released sheet. The release means includes a push-plate movable between an upper position and a lower position. The push-plate presses downward on a sheet being released from the transfer means whereby the sheet floats downward. The improvement comprises a hold-down means which contacts the released sheet during its entire downward motion. The hold-down means includes a bar member which has a contact surface for contacting the upper major surface of the released sheet and a support member for supporting the bar member. The support member supports the bar member for motion between an inoperative position wherein the bar member is out of contact with the released sheet and an operative position wherein the bar member contacts the upper major surface of the released sheet. The support member includes at least one arm supported by the push-plate in the inoperative position of the hold-down means when the push-plate is in its upper position.

In the preferred embodiment, the transfer means is comprised of an endless belt-vacuum transfer means which utilizes a pair of spaced parallel vacuum-applying endless belts. A push-plate is disposed adjacent each of the vacuum-applying belts and exerts a downward force upon a sheet to be released sufficient to separate the sheets from the vacuum lifting force of the belts. The hold-down means includes a pair of the bar members, with one of the bar members disposed adjacent each of the push bars. Each of the bar members is attached to a free end of a pair of spaced pivotable arms and includes a shaft to which a plurality of rotatable rollers are attached.

A conveyor mechanism is preferably disposed at the second station for conveying the released sheets away from the second station. In one embodiment, the conveyor mechanism is a glue line conveyor in a plywood manufacturing apparatus. The conveyor mechanism moves the sheets in a first direction. The bar members extend in a second direction transverse to the first direction and across a major portion of the width of the released sheets. One of the bar members is disposed adjacent a first end of the released sheet in the first direction and a second bar member is disposed adjacent a second opposite end of the released sheet in the first direction.

By disposing the bar members at opposite longitudinal ends of the released sheet, downward pressure is effectively applied at both ends of the floating sheet to prevent the sheet from being entrapped on a cushion of air beneath it. Since the rollers are permitted to rotate, the bar members can remain in contact with the released sheet for a portion of the time it is being moved by the conveyor mechanism. The operative connection between the hold-down means and the push bars affords a simple and reliable interconnection between the release mechanism which releases the sheets from the transfer mechanism and the hold-down bar members.

Various advantages and features of novelty which characterize the invention are pointed out with particularity in the claims annexed hereto and made a part hereof. However, for a better understanding of the invention, its advantages, and objects obtained by its used, reference should be had to the drawings which form a part hereof and to the accompanying descriptive matter, in which there is illustrated and described a preferred embodiment of the invention.

DETAILED DESCRIPTION OF THE INVENTION

Figure 1:
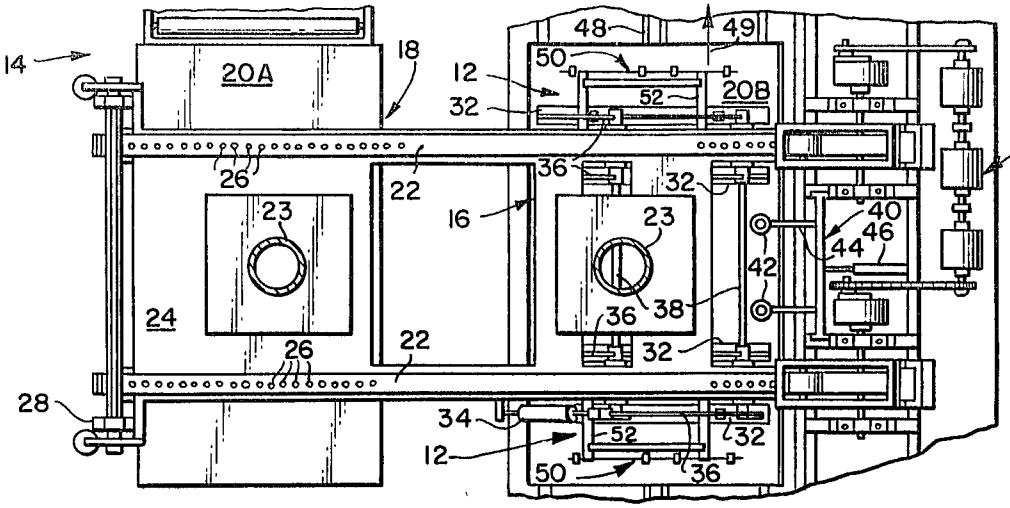
FIG. 1 is a fragmentary schematic plan view of a sheet transfer device in accordance with the present invention, incorporating a sheet hold-down mechanism.
Figure 2:
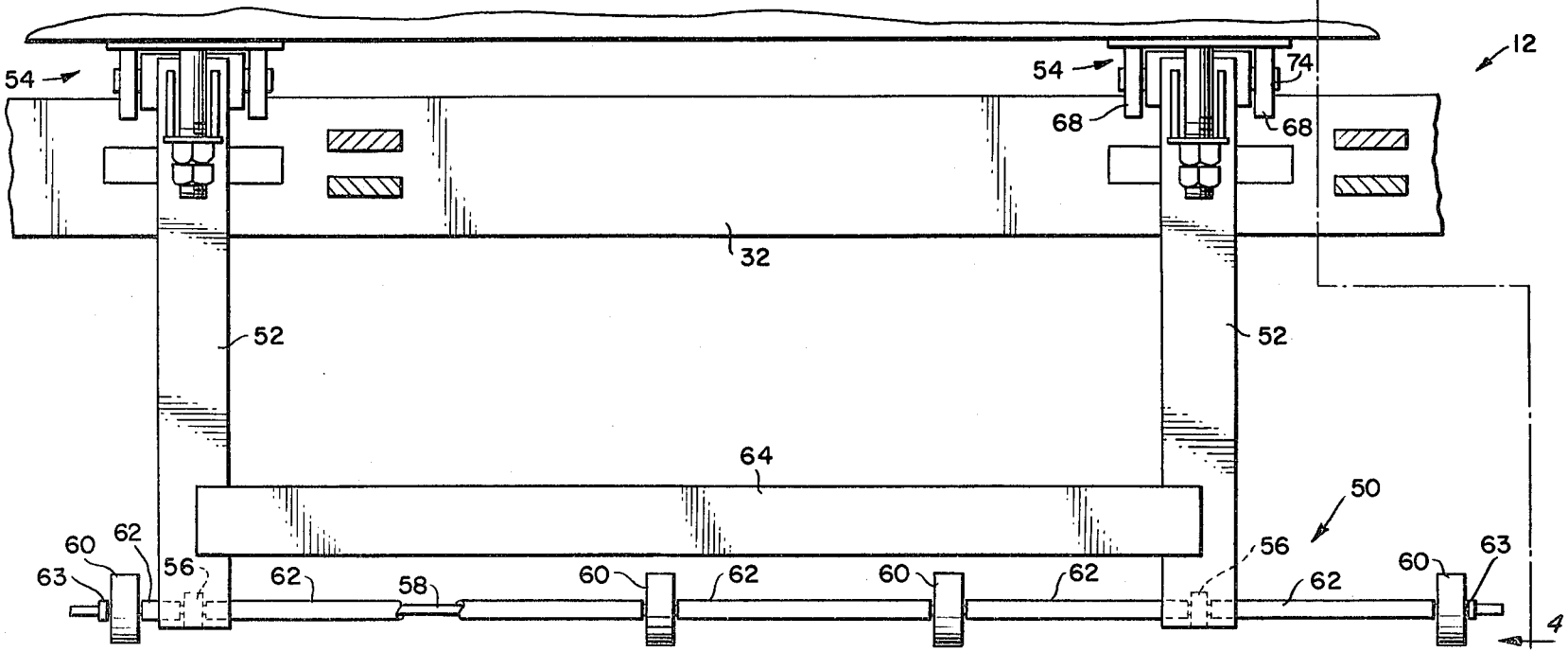
FIG. 2 is an enlarged fragmentary top plan view of a sheet hold-down mechanism in accordance with the present invention.
Figure 3:
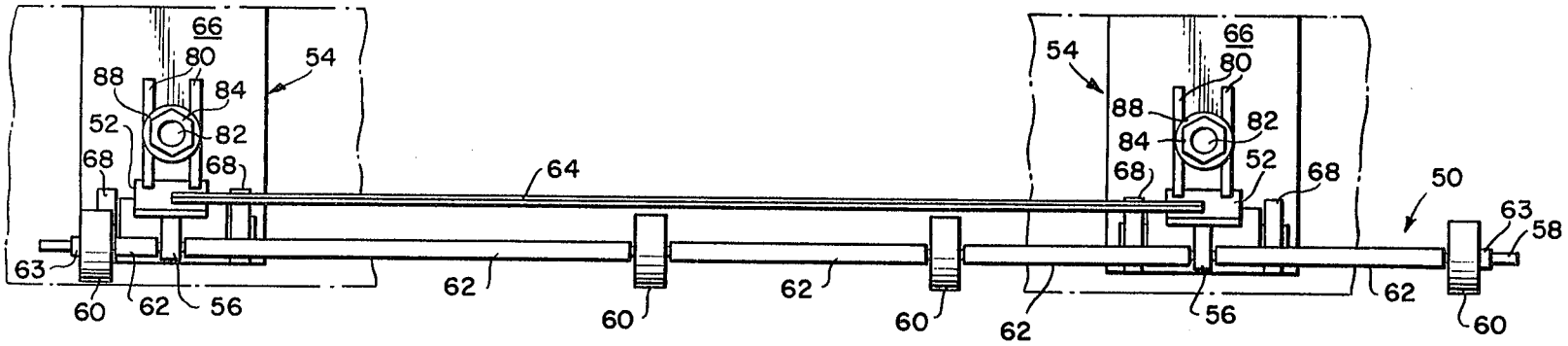
FIG. 3 is an enlarged side elevational view of the hold-down mechanism.
Figure 5:
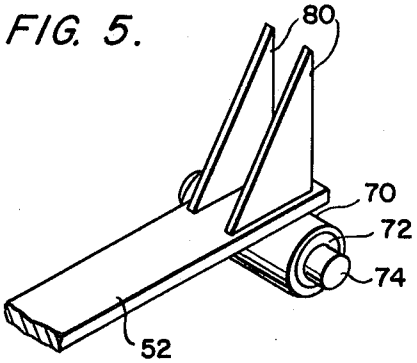
FIG. 5 is a perspective view of a portion of the hold-down mechanism illustrating its pivotable connection.

Referring to the drawings in detail, wherein like numerals indicate like elements, there is shown in FIG. 1 a sheet transfer apparatus in accordance with the present invention designated generally as 10 and sheet hold-down assemblies in accordance with the present invention designated generally as 12. The sheet transfer apparatus 10 is shown in a preferred use within a portion of an overall apparatus for the production of plywood or a similar article.

The transfer apparatus 10 includes a first station 14, a second station 16 and a vacuum transfer mechanism 18. A stack of individual sheets, such as wood veneer or similar stiff, structural sheets are delivered to the first station 14, the top sheet of the stack is seen in FIG. 1 and indicated at 20A.

The vacuum transfer mechanism 18 includes a pair of spaced parallel vacuum-applying endless belts 22. A vacuum is applied to the belt 22 from a source through conduits 23 to a plenum 24. Vacuum lifting force is applied to the sheet 20A through apertures 26 formed in the belts 22.

A lifting mechanism 28 moves the end of belts 22 adjacent the first station upwardly and downwardly. When the lift mechanism 28 moves the belts 22 downward, the belts 22 are disposed close to the uppermost sheet 20A and the vacuum applied through aperatures 26 holds the sheet 20A to each belt 22. The lift mechanism 28 can thereafter move the belts 22 upward and a drive mechanism 30 drives the belts 22 to move the lifted sheet 20A to the second station 16. The apparatus 10 can concurrently handle two sheets. A sheet 20B, which has already been lifted and transferred from the first station 14, is shown at the second station 16. Two pairs of push-plates 32 are arranged parallel to the belts 22, one pair stradling each of the belts 22. The plates 32 are substantially as long as the sheet 20B is wide.

A drive mechanism is provided for moving the push-plates 32 synchronously upwardly and downwardly. In the embodiment shown, a fluid operated cylinder 34 is coupled to each of the push-plates 32 by means of a plurality of parallelogram linkeage assemblies 36 interconnected by cross-shafts 38. A sheet 20B is removed from the belts 22 without releasing or cutting off the vacuum applied to the sheet 20B. The push-plates 32 therefore push downwardly upon the sheet 20B with sufficient force to move the sheet 20B away from the vacuum lift of the belts 22. Thereafter, the sheet 20B is free to float downwardly.

A floating weight assembly 40 superimposes a floating weight of predetermined magnitude on the upper surface of the sheet 20B as it drops from the vacuum belts 22. As seen in FIG. 1, the floating weight assembly 40 is disposed centrally along one lengthwise edge of the sheet 20B. The floating weight assembly 40 includes a pair of shoes 42 mounted on vertically extending rods. The shoes 42 and rods extending therefrom are carried by a support assembly 44. The support assembly 44 and depending shoes 42 are moved between operative and inoperative position by a fluid operated cylinder 46. In an inoperative position, the shoes 42 are out of contact with the upper surface of sheet 20B, and in the operative position, the shoes 42 are free to press downwardly upon the outer surface of sheet 20B.

A portion of a primary conveyor mechanism 48 is located at the second station 16 below belts 22. In a prefered embodiment, the conveyor mechanism is a glue-line conveyor of a plywood or similar article manufacturing apparatus. The sheet 20B floats down onto the conveyor mechanism 48 after it has been released from the belts 22. The conveyor mechanism 48 thereafter moves the sheet 20B away from the second station 16 in the direction of arrow 49. For a more detailed discussion of the transfer apparatus 10, as discussed to this point in detailed description, reference is made to U.S. Pat. No. 3,490,614 to R. W. Wilson, et al. issued on Jan. 20, 1970, the disclosure of which is incorporated herein by reference.

The hold-down assembly 12 is shown in detail in FIGS. 2–5. The hold-down mechanism 12 is comprised of a bar assembly 50 supported at the free distal end of each of a pair of pivot arms 52. Each pivot arm 52 is connected to a pivot support assembly 54. The support assemblies 54 are fixed to a side of the transfer apparatus 10 adjacent each endless belt 22. As seen in FIG. 1, one bar assembly 50 and one pair of pivot arms 52 extend outwardly from the side of each endless belt 22 at the second station 16. The bar assemblies 50 extend transverse to the conveying direction 49 of conveyor mechanism 48 and extend over a major portion of the width of sheet 20B. Since each bar assembly 50, together with its associated pivot arms and support assembly 52, 54 are alike, only one will be discussed in detail.

A support plate 56 is attached to and extends downwardly from each of the pivot arms 52 adjacent their distal ends. A support shaft 58 extends through an aligned hole in each of the support plates 56. A plurality of rollers 60 are attached to the shaft 58 at a plurality of spaced locations along its length. The rollers 60 are conventional and have annular bearings about which the outer portion of the rollers is free to rotate. For example, skate rollers have been found suitable for use as rollers 60. The outer circumferential surface of each roller 60 serves as a contact surface of the bar assembly 50 for contacting the upper major surface of sheet 20B. A plurality of spacer tubes or cylinders 62 are received about the shaft 58 and establish the spacing between the rollers 60. One of tubes 62 is disposed between each of the outermost rollers 60 and the support plate 56 adjacent to it. Another spacer 62 is disposed between each support plate 56 and one of the rollers 60 disposed inward of the support plates 56. One of the spacer tubes 62 is also disposed between the two innermost rollers 60. A set collar 63 is fixed to each longitudinal end of the shaft 58. A cross brace in the form of a flat plate 64 is attached to the upper surface of each pivot arm 52 adjacent its distal end and extends between the arms 52 to increase the strength of the hold-down mechanism adjacent the distal ends of the pivot arms 52.

Each pivot support assembly 54 is constructed alike and, hence, only one assembly 54 will be discussed in detail. A connector plate 66 is attached to a portion of the apparatus 10, preferably to a vertical wall of the air plenum 24, and a pair of spaced support flanges 68 are attached to and extend outwardly from the connector plate 66. A tube 70 is attached to the lower surface of the pivot arm 52 adjacent the end of arm 52 which is proximate the support flanges 68. A bearing 72 is received within the hollow interior of the tube 70 and a rod 74 is carried within the hollow interior of bearing 72. The rod 74 is supported within holes of an adjacent pair of support flanges 68. The pivot arm 52 is thus supported for pivoting motion about the axis of rod 74.

Figure 4:
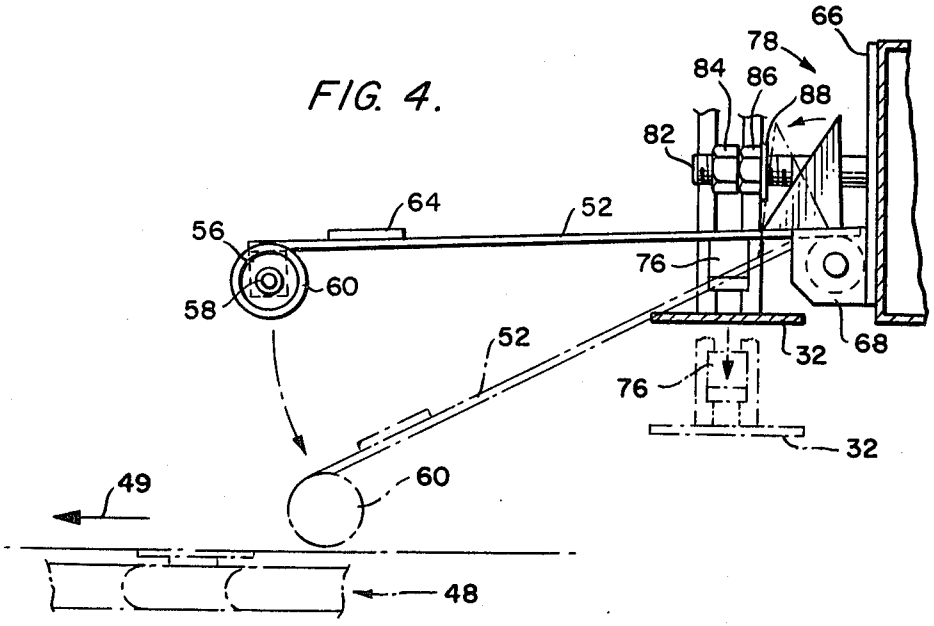
FIG. 4 is an elevational view, partially in section, taken generally along lines 4—4 of FIG. 2.

A support block 76 is attached above the top surface of push-plate 32. As seen full line in FIG. 4, support block 76 holds the pivot arm 52 in an upper inoperative position wherein rollers 60 are out of contact with sheet 20B when the push-plate 32 is in an upper disposition. When the push-plate 32 is moved downwardly to disengage a sheet from the vacuum-applying belts 22, as seen in phantom line in FIG. 4, the pivot arms 52 are free to move downwardly. The rollers 60 can thereby contact and place pressure upon the upper surface of sheet 20B. Also as seen in FIG. 4, the arms 52 in their lowermost disposition are out of contact with support block 76. Push-plates 32 move the support blocks 76 out of contact with the arms 52 so that the arms 52 are free to pivot downwardly without contact with the support block 76 through substantially all their downward pivoting motion.

Similar stop assemblies phantom line 78 are provided adjacent each pivot support assembly 54 to stop the downward pivoting motion of the arms 52 at a selected position. A pair of stop plates 80 are attached to and extend upwardly from the top surface of the pivot arm 52. A bolt 82 is attached to and extends from the connector plate 66. The bolt 82 passes between the pair of stop plates 80. A pair of nuts 84, 86 are received about the bolt 82 and a washer 88 is affixed to the inner surface of the innermost bolt 86. By adjusting the position of the nuts 84, 86, the amount which the arms 52 pivot downwardly can be adjusted. As seen in plantom line in FIG. 4, the stop plate 80 contacts the washer 88 to stop the downward pivoting of the arms 52.

The capability to adjust the amount which the arms 52 pivot downwardly is particularly useful in a plywood manufacturing apparatus wherein a plurality of sheet transfer stations are disposed along a glue line conveyor. In such an apparatus, an additional sheet is added to the plywood being formed along the glue line conveyor at each of the sheet transfer stations so that the thickness of the plywood is gradually increased. It is therefore desirable to adjust the amount which the hold-down assembly 12 pivots downwardly in order to accommodate the increasing thickness of the plywood being formed. The stop assembly 78 provides such adjustability.

The hold-down assembly 12 operates in the following manner. After a sheet 20B has been transfered to the second station 16 by the vacuum-applying belts 22, push-plates 32 are moved downward from their uppermost position. The plates 32 press downward on the sheet 20B with sufficient force to release the sheet 20B from the vacuum force of belts 22. The sheet 20B is thereafter free to move downwardly. As the plates 32 move downward, the support blocks 76 move away from the pivot arms 52 and the arms 52 are free to pivot downwardly. The rollers 60 then come into contact with the upper surface of sheet 20B at either longitudinal end thereof. A downward force is thus applied to the sheet 20B to aid its downward floating motion and to prevent the sheet from floating on an entrapped cushion of air beneath it. The rollers 60 remain in contact with the sheet 20B during its entire downward motion and momentarily as the conveyor 48 moves the sheet 20B away from station 16. The arms 52 are thereafter raised to their upper inoperative position by the motion of plates 32 upward to their inoperative positions.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extend indicated by the board general meaning of the terms in which the appended claims are expressed.

I claim:

1. A sheet transfer apparatus comprising:

a first station;

a second station;

means for transferring stiff sheets from said first station to said second station;

conveyor means for moving sheets in a first direction from said second station;

a portion of said transfer means being located adjacent said second station to hold a sheet above said conveyor means;

release means for releasing a sheet held by said transfer means at said second station from said transfer means to allow the released sheet to float downwardly to said conveyor means whereby the released sheet can subsequently be moved by said conveyor means;

hold-down means comprised of first and second bar members with contact surfaces for contacting the upper major surface of the released sheet during its entire downward floating motion, said first and second bar members extending in a second direction transverse to said first direction and across a major portion of the released sheet's dimension in said second direction, said first bar member being disposed adjacent a first end of the released sheet in said first direction and said second bar being disposed adjacent a second opposite end of the released sheet in said first direction.

2. An apparatus in accordance with claim 1, wherein the contact surface of said bar members is rotatable.

3. An apparatus in accordance with claim 2, wherein each bar member includes a shaft and a plurality of rollers connected to said shaft at spaced locations along the length thereof, the outer circumferential surface of each roller forming a portion of said contact surface of said bar member to which it is attached, the width of each of said rollers being substantially less than the width of the released sheet.

4. An apparatus in accordance with claims 1, 2 or 3, wherein each bar member is connected to a free end of pivoting arm means, said pivoting arm means having a second end connected to said apparatus for pivotable motion, said pivoting arm means supporting said bar members for pivoting motion between an inoperative position wherein said contact surface of said bar members is out of contact with the upper major surface of the released sheet and operative position wherein the pivoting arm means and attached bar members are free to move downwardly with said contact surfaces contacting the released sheet.

5. An apparatus in accordance with claim 4 wherein said pivoting arm means in said operative position pivots unhindered except for contact with the released sheet.

6. An apparatus in accordance with claim 5, including adjustable stop means for stopping the downward motion of said pivoting arm means at one of plurality of selectable locations.

7. An apparatus in accordance with claim 6, wherein said pivoting arms means includes a pair of spaced parallel arms each having a first distal end and a second end, the first end of each arm supporting one of said bar members and the second end being connected for pivotal motion to said apparatus, said adjustable stop means including a stop plate connected to the second end of each arm, a stop member extending from said apparatus, said stop member having a stopping surface for contacting said stop plate to stop the downward pivoting motion of said arms, said stopping surface being movable to a plurality of locations whereby the amount of pivoting motion of said arms is adjustable.

8. An apparatus in accordance with claim 4, wherein said release means includes a push plate movable upwardly and downwardly between an upper inoperative position and downward operative position, said push plate in its upper position supporting said pivoting arms means in its inoperative position and in its downward position releasing a sheet from said transfer means and allowing said pivoting arm means to pivot downward.

9. In a sheet transfer apparatus including transfer means for transfering stiff sheets from a first station to a second station, release means for releasing a sheet held by said transfer means at said second station and for providing a downward force on the released sheet, said release means including a push plate movable between an upper position and a lower position for pressing downward on the sheet being released from the transfer means whereby the released sheet floats downward, the improvement comprising hold-down means for contacting the released sheet during its entire downward motion, said hold-down means including a bar member having a contact surface for contacting the upper major surface of the released sheet and a support member for supporting said bar member for motion between an inoperative position wherein said bar member is out of contact with the released sheet and an operative position wherein said bar member contacts the upper major surface of said released sheet, said support member including at least one arm supported by said push plate in the inoperative position of said hold-down means in the upper position of said push plate and said support member being free to move downwardly when said push plate is in the lower position.

10. In an apparatus in accordance with claim 9, wherein said contact surface of said bar member is rotatable.

11. In an apparatus in accordance with claim 10, wherein said support member includes a pair of said arms, said bar member including a shaft supported by a distal end of each of said arms and extending between said arms, a plurality of rollers spaced along the length of and supported by said shaft, said rollers each having a rotatable outer surface forming said contact surface.

12. In an apparatus in accordance with claim 11, wherein said rollers are disposed along a major portion of the sheet being transferred in the direction of said shaft.

13. In an apparatus in accordance with claim 11, wherein each of said arms has a second end pivotably connected to said apparatus adjacent to said push-plate.

14. In an apparatus in accordance with claim 13, including adjustable stop means for adjusting the amount said arms can pivot.

15. In an apparatus in accordance with claim 9, including a pair of said bar members, one of said bar members being disposed adjacent one longitudinal end of a sheet to be released and the other of said bar members being disposed adjacent an opposite longitudinal end of the sheet to be released.

16. In a sheet transfer apparatus including an endless belt vacuum transfer means for transferring stiff sheets from a first station to a second station, the transfer means including a pair of spaced parallel vacuum-applying endless belts, release means for releasing a sheet from the vacuum-applying belts to allow the released sheet to float downward at the second station, said release means including a push plate disposed adjacent each of the vacuum-applying belts, each of the push plates being moveable from an upper position out of contact with the sheet being released and a downward position into contact with the sheet held by the vacuum-applying belts to release the last-mentioned sheet from the holding force of the vacuum-applying belts to allow the released sheet to float downward, the improvement comprising:

hold-down means for contacting the upper major surface of the released sheet during substantially its entire downward motion; said hold-down means including a bar member movably disposed adjacent each of said push bars, each bar member having a contact surface for contacting the upper major surface of the released sheet, each bar member being attached to a pair of spaced pivotable arms, each pair of spaced pivotable arms being connected to said apparatus for pivotable motion between an upper inoperative position wherein said bar members are out of contact with the released sheet and an operative position wherein the bar members and the pivotable arms are free to move downwardly, each pair of pivotable arms being supported in the inoperative position by one of said push plates and being released to said operative position when said push plates move downwardly to release a sheet from said vacuum-applying belts.

17. In an apparatus in accordance with claim 16, wherein each bar member includes a shaft extending between and supported by a pair of said spaced pivotable arms, a plurality of rollers attached to said shaft at spaced locations along its length, the outer surface of each roller being rotatable and forming said contact surface, said rollers being disposed along a major portion of the dimension of the sheet along which said shaft extends.

18. In an apparatus in accordance with claim 16, wherein each pair of said pivot arms is pivotably connected to said apparatus at a location inward of a respective one of said push-plates and extends above said push-plate.

19. In an apparatus in accordance with claim 18, including an adjustable stop means for adjusting the amount said pivot arms can pivot downwardly.

20. In an apparatus in accordance with claim 19, wherein said adjustable stop means includes a pair of stop plates attached to and extending upwardly from a top surface of each of said pivot arms adjacent the pivotable connection of said arms, a bolt extending from said apparatus and passing between each pair of said stop plates, and nut means carried by each of said bolts and positionable along the length thereof, said nut means having a stopping surface for contacting a respective one of said stop plates to stop the downward pivoting motion of said arms.

21. A sheet transfer apparatus comprising:

a first station;

a second station;

vacuum transfer means for transferring stiff sheets from said first station to said second station, said vacuum transfer means including a pair of spaced parallel vacuum-applying endless belts for applying a vacuum lifting force on a sheet to be transferred;

conveyor means for moving sheets in a first direction from said second station;

a portion of said transfer means being disposed above said conveyor means to hold a sheet being transferred thereabove;

release means for releasing a sheet held by said transfer means at said second station from said transfer means to allow the released sheet to float downwardly to said conveyor means, said release means including a push-plate movable upwardly and downwardly between an upper inoperative position and a lower operative position whereby said push-plate presses against a sheet held by said transfer means above said conveyor means and presses downwardly on said sheet to release said sheet from the vacuum lifting force of said vacuum-applying endless belts;

hold-down means including first and second shafts, each of said shafts having a plurality of rollers and disposed along its length with an outer rotatable surface of each roller forming a contact surface for contacting the upper major surface of the released sheet during its entire downward floating motion, said first and second shafts extending in a second direction transverse to said first direction, said rollers being located across a major portion of the released sheet's dimension in said second direction, said first shaft being pivotably supported by a pair of pivot arms adjacent the first end of the released sheet in said first direction, and said second shaft being pivotably supported by a pair of pivot arms adjacent a second opposite end of the released sheet in said first direction;

each pair of said spaced pivotable arms being connected to said apparatus for pivotable motion between an inoperative position wherein said rollers are out of contact with the released sheet and an operative position wherein the rollers and the pivotable arms are free to move downwardly for the rollers to contact and press down upon the released sheet, each pair of pivotable arms being supported in the inoperative position by one of said push-plates when said push-plate is in its upper position and being released to said operative position when said push-plate move downwardly to release a sheet from said vacuum applying belts; and stop means for stopping the downward pivoting motion of each pair of pivotable arms.

22. A sheet transfer apparatus in accordance with claim 21 wherein said stop means is adjustable to adjust the amount each pair of pivot arms can pivot downward.

* * * * *